United States Patent [19]

Olask

[11] 4,067,325

[45] Jan. 10, 1978

[54] FRICTION MASSAGE MEMBER

[76] Inventor: Antoinette S. Olask, 600 NE. 36 St. Charter Club No. 802, Miami, Fla. 33137

[21] Appl. No.: 720,554

[22] Filed: Sept. 7, 1976

[51] Int. Cl.[2] ..... A61H 7/00

[52] U.S. Cl. ..... 128/62 R; 15/222; 15/227

[58] Field of Search ..... 128/62, 63, 67, 65; 15/208, 209 C, 222, 227; 4/184

[56] References Cited

U.S. PATENT DOCUMENTS

| | | | |
|---|---|---|---|
| 1,141,580 | 6/1915 | Reddick | 128/62 R |
| 1,208,064 | 12/1916 | Wilber | 128/62 R |
| 2,439,249 | 4/1948 | Hickman | 15/222 |
| 2,533,036 | 12/1950 | Moscowitz | 128/62 R |

*Primary Examiner*—Lawrence W. Trapp

[57] ABSTRACT

A friction massage member in the form of a strap or mitten which includes a rubbing surface to be rubbed over the human body. The member is composed of strands knitted in a pattern defining a surface with high and low areas adjacent to one another and which strands are composed of a mixture of vegetable and animal fibers at a ratio of about 50% each and wherein the vegetable fiber component is about 50% sisal and 50% alfa and the animal hair is about 50% coarse animal hair, such as horse hair, and 50% fine animal hair, such as elephant hair.

5 Claims, 5 Drawing Figures

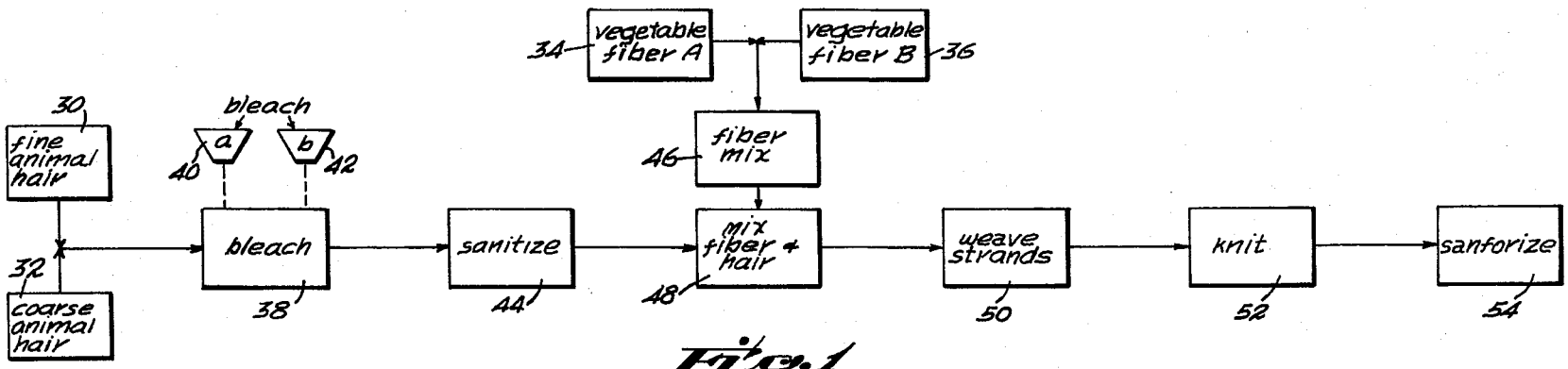
Fig. 1
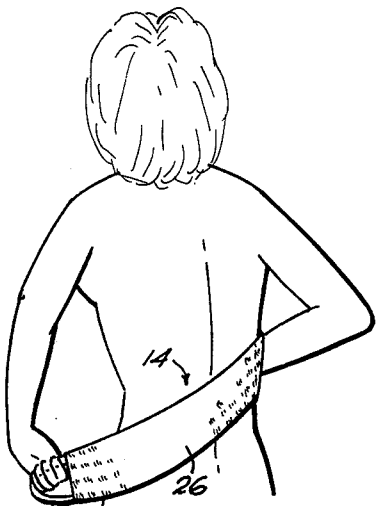
Fig. 2
Fig. 3
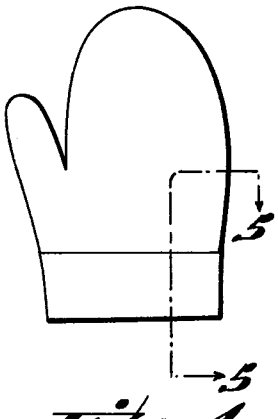
Fig. 4
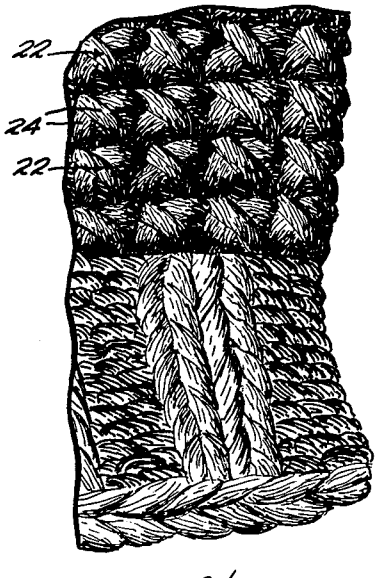
Fig. 5

FRICTION MASSAGE MEMBER

FIELD OF THE INVENTION

This invention relates to a cloth in the form of a device for gripping by a human and for applying friction by rubbing it over the surface of the body.

BACKGROUND OF THE INVENTION

In the past, there have been numerous recognitions of the utilization of a friction or rubbing material on the surface of the human body to remove dead skin and to generally give a feeling of good tone. This invention is of such a device.

OBJECTS OF THE INVENTION

It is an object of this invention to provide an improved cloth of woven strand material which is knitted into a pattern in relief with, preferably, rows and columns of adjacent high areas wherein the surface of the strands are of a preferred consistency and which can resist water and, indeed, are softened by water so that the same may be used with the beneficial results in the bath. In the preferred embodiment, the strands are 50% vegetable fiber and 50% animal fiber with the vegetable fiber being composed, preferably, of about 50% alfa and 50% sisal and the animal hair being about 50% coarse animal hair, such as horse hair, and about 50% fine animal hair, such as elephant hair; however, the range of the mixture may vary somewhat and in the range of about 10% plus or minus for the given ingredients of hair and fiber or the mixture of the same.

In accordance with the foregoing and the description which follows, the instant invention is to be described with reference to the accompanying drawings in which:

DESCRIPTION OF THE DRAWINGS

FIG. 1 is a diagramatic view illustrating the steps in the manufacture of the device;

FIG. 2 is a view illustrating the use of the material in a mitten form;

FIG. 3 is a view illustrating the use of the material in a strap form;

FIG. 4 is a view of the mitten shown in FIG. 2; and

FIG. 5 is an enlarged partial view of that portion of FIG. 4 indicated by the arrowed line 5—5 therearound for purposes of illustrating the cuff of the mitten and the pattern in relief which typifies the knit stitch used in weaving these strands.

DESCRIPTION OF PREFERRED EMBODIMENT

Referring to the drawings wherein like reference characters designate like or corresponding parts throughout the several views, there is shown in FIG. 2 a glove which is generally designated by the numeral 10. Perhaps, more aptly described this is a mitten in the sense that there is a thumb socket 18 and a hand socket 16 and the mitten portion is provided with a mouth having an expandable zone 20 annularly arranged thereabout. As an alternative, there is shown in FIG. 3 a strap generally designated by the numeral 14 which includes a main longitudinal length zone 26 with handles 28 on the opposite ends for manipulating it with respect to the back or other portions of the body. With respect to FIG. 4, there has been an enlarged zone shown and designated by the arrowed line 5. It is seen that the main mitten portion is composed of woven portions defining a pattern in relief, that is with high and low areas, the high areas being designated by the numeral 22 and being composed of a stitched zone wherein the filaments of the strands 24 are elevated. The stitch of the mitten is different from that of the cuff 20 in that it includes symmetrical raised portions 22 formed by woven strands with the raised portions being preferably in rows and columns as indicated.

The glove and strap are made of fine animal hair 30, such as elephant hair, which is mixed in equal proportion, preferably, with coarse animal hair 32 such as horse hair and, thereafter, bleached in a vat as at 38 by a suitable solution which may be hydrogen peroxide 40 mixed with ammonium hydroxide 42. After bleaching, the bleached mixed animal hair is sanitized by the application of heat as at 44 which dries it. It is then mixed with a vegetable fiber mix 46 at 48, with the mixture being roughly 50% animal fiber and 50% vegetable fiber; however, variations within the range of 10% of each are within the range of the invention set forth. The vegetable fiber is of two types, 34 and 36, a first vegetable fiber sisal is utilized which is a relatively coarse long fiber in the range of 6 to 8 feet. The second vegetable fiber is known as alfa from a fiber producing plant which is widely used by Middle Eastern people in hammams and is of a similar length to that of the sisal. The vegetable and animal hair are mixed together at 48 and, thereafter, the filaments of hair are woven together with the strands of vegetable fiber into strands as at 50 which are then knitted together as at 52 and this defines the mittens 10 or the straps 14 which are then, preferably, sanforized for the complete product. In use, the relative coarse 6 to 8 inch length horse hair or coarse animal hair being mixed with the relatively short and fine elephant hair of about 2 inches length and at a ratio of about 50% each and the vegetable fiber each mixed 50—50 with the other and the aanimal hair and vegetable fiber being mixed together at equal proportions, within a range of about 10% plus or minus, provides a woven mitten which has a consistency which permits it to be rubbed on the body when wet, not to deteriorate from wetness, and to be utilized for increasing blood circulation on the epidermis so that the user, upon massaging or rubbing himself with it gets a feeling of well being and there is a toning effect on the skin. The mitten should be used regularly in bathing to soothe and manipulate the surface of the skin to help to clean it and tone it.

What is claimed is:

1. A piece of cloth including means for gripping the same and which cloth is for use in massaging and cleaning the body and comprises a pattern of knitted strands which are each composed of an interwoven mixture of 50% animal hair and 50% of vegetable hair, said vegetable hair being about 50% sisal and about 50% alfa and said animal hair being about a) 50% animal hair selected from the class which includes horse hair and b) 50% animal hair selected from the class which includes elephant hair, and said animal hairs being bleached and mixed with said vegetable fiber prior to weaving the strands and knitting the material.

2. The device as set forth in claim 1 wherein the material is sanforized.

3. The device as set forth in claim 1 wherein the material is woven in the form of a mitten.

4. The device as set forth in claim 3 wherein the surface of the mitten includes a palm zone and the palm zone includes a pattern in relief comprising high and low areas and said high areas are a generally bumpy stitch.

5. The device as set forth in claim 1 wherein the device is woven into the form of a strap.

* * * * *